US011181298B2

(12) United States Patent
Zauderer et al.

(10) Patent No.: US 11,181,298 B2
(45) Date of Patent: Nov. 23, 2021

(54) AIR CONDITIONING DIFFUSER ASSEMBLY

(71) Applicant: ACP Ltd., Yesodot (IL)

(72) Inventors: Ron Zauderer, Petah Tikva (IL); Yehuda Klein, Rehovot (IL)

(73) Assignee: ACP Ltd., Yesodot (IL)

( * ) Notice: Subject to any disclaimer, the term of this patent is extended or adjusted under 35 U.S.C. 154(b) by 0 days.

(21) Appl. No.: 16/780,936

(22) Filed: Feb. 4, 2020

(65) Prior Publication Data

US 2020/0248926 A1 Aug. 6, 2020

(51) Int. Cl.
*F24F 13/14* (2006.01)
*F24F 13/15* (2006.01)

(52) U.S. Cl.
CPC ..... *F24F 13/1406* (2013.01); *F24F 13/1413* (2013.01); *F24F 13/15* (2013.01)

(58) Field of Classification Search
CPC ..... B60H 1/248–249; B60H 1/3421; F24F 13/1406; F24F 13/1413; F24F 13/15; F24F 13/1486
USPC ..... 454/313–314, 318, 320; 49/91.1, 92.1
See application file for complete search history.

(56) References Cited

U.S. PATENT DOCUMENTS 3,858,491 A * 1/1975 Dravnieks ..... F24F 13/075 454/320
2014/0326794 A1* 11/2014 Frank ..... F24F 13/075 236/49.3
2019/0366807 A1* 12/2019 Frisch ..... B29C 48/12

* cited by examiner

*Primary Examiner* — Vivek K Shirsat
(74) *Attorney, Agent, or Firm* — Dekel Patent Ltd.; David Klein

(57) ABSTRACT

An air conditioning diffuser assembly includes louvers mounted in a housing, each of louvers being pivotally mounted in a sealing channel formed in a sealing member received in a louver holder. The seal has sufficient sealing capability to prevent condensation from entering the louver holder.

9 Claims, 2 Drawing Sheets

AIR CONDITIONING DIFFUSER ASSEMBLY

FIELD OF THE INVENTION

The present invention generally relates to air conditioners, and more particularly to an air conditioning diffuser assembly which prevents condensation accumulation.

BACKGROUND OF THE INVENTION

Many air conditioners discharge cold air through a diffuser that can direct the air flow in different directions. Since the diffuser is in the cold air stream, it and its surrounding structure approach the temperature of the cold discharge air. However, warm, moisture-laden air within the room that contacts the diffuser blades (louvers) can cause condensation to form on the blades of the diffuser. Condensation can also occur from what is known as the entrainment effect, as is now explained. Cold air is discharged from the air conditioner diffuser at sufficient velocity that lowers pressure in the air near the diffuser exit. The lowered pressure causes warm, moist air near the diffuser to be entrained, that is, sucked back into the diffuser. Wherever the entrained air touches a cold part, such as the diffuser blades or diffuser housing, moisture from this air condenses out. The condensed water can remain on the louvers and cause mold and mildew to accumulate or can cause corrosion on the parts of the diffuser.

SUMMARY OF THE INVENTION

The present invention seeks to provide a novel and improved air conditioning diffuser assembly which prevents condensation accumulation, as described in detail below.

There is thus provided in accordance with a non-limiting embodiment of the present invention an air conditioning diffuser assembly including louvers mounted in a housing, each of louvers being pivotally mounted in a sealing channel formed in a sealing member received in a louver holder, the seal having sufficient sealing capability to prevent condensation from entering the louver holder.

In accordance with a non-limiting embodiment of the invention each of the sealing members is received in a louver channel formed in each of the louver holders.

In accordance with a non-limiting embodiment of the invention the sealing members are made of an elastomeric material.

In accordance with a non-limiting embodiment of the invention each of the louvers includes a blade portion that extends from a pivot bar, there being a groove between the blade portion and the pivot bar, the pivot bar being received in the sealing channel.

In accordance with a non-limiting embodiment of the invention the blade portion tapers in thickness in a direction away from the pivot bar.

In accordance with a non-limiting embodiment of the invention the groove allows the blade portion to pivot in an angular range before abutting against edges of the louver holder.

In accordance with a non-limiting embodiment of the invention the housing includes a frame and an assembly of the louvers, the sealing members and the louver holders are affixed to the frame by magnetic fasteners.

In accordance with a non-limiting embodiment of the invention portions of mounting strips are received in the sealing members and the mounting strips are affixed to the frame by the magnetic fasteners.

In accordance with a non-limiting embodiment of the invention the mounting strips are located in spaces between louvers that are adjacent one another.

BRIEF DESCRIPTION OF THE DRAWINGS

The present invention will be understood and appreciated more fully from the following detailed description, taken in conjunction with the drawings in which.

DETAILED DESCRIPTION OF EMBODIMENTS

Figure 1:
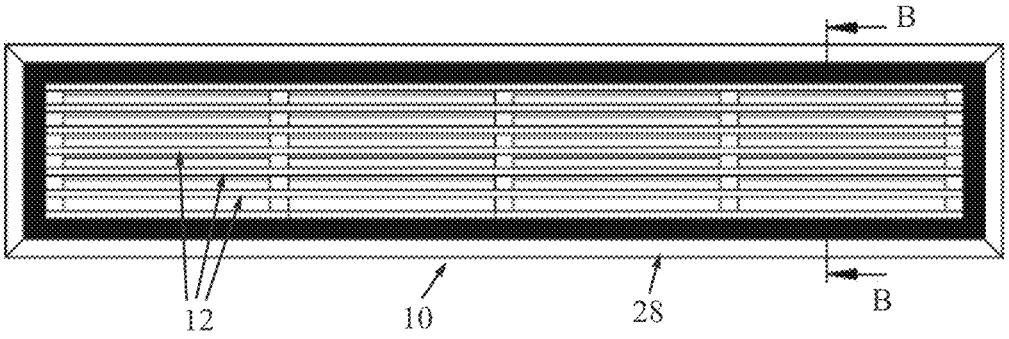
FIG. 1 is a simplified perspective illustration of an air conditioning diffuser assembly, in accordance with a non-limiting embodiment of the present invention.
Figure 2:
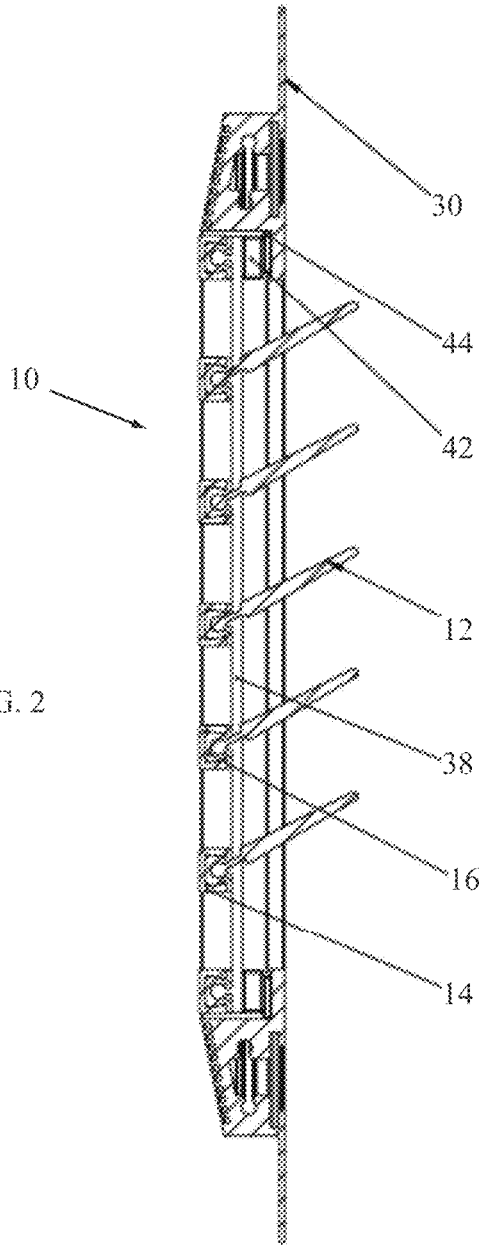
FIG. 2 is a simplified sectional, side-view illustration of the assembly, taken along lines B-B in FIG. 1.
Figure 3:
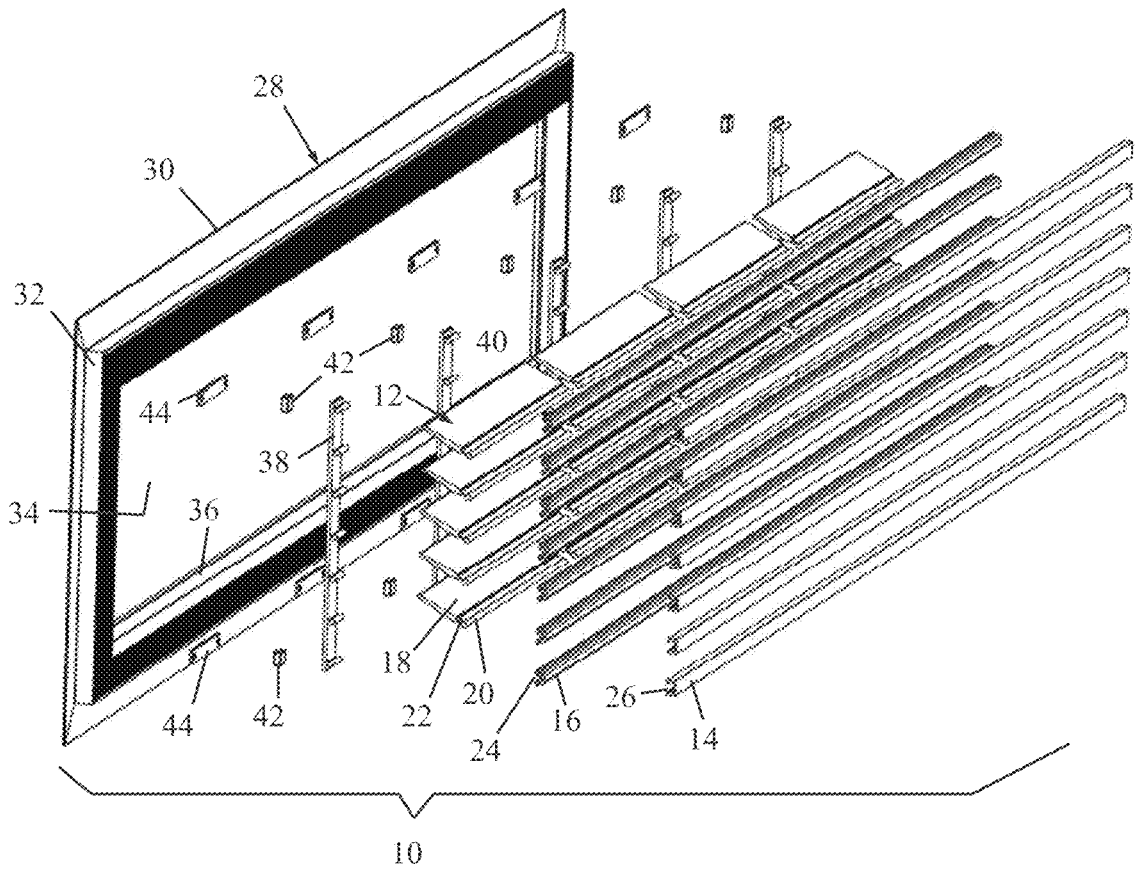
FIG. 3 is a simplified exploded illustration of the assembly.

Reference is now made to FIGS. 1-3, which illustrate an air conditioning diffuser assembly 10, constructed and operative in accordance with a non-limiting embodiment of the present invention.

The air conditioning diffuser assembly 10 includes louvers 12 (also referred to as diffuser blades 12), each of which is pivotally mounted in a louver holder 14. In contrast with the prior art, the louver 12 is not directly mounted in the louver holder 14. Instead, a sealing member 16 (seal 16) is placed intermediate the louver 12 and the louver holder 14. Seal 16 is preferably made of an elastomeric material, such as natural or synthetic rubber.

Reference is made particularly now to FIG. 3. In the non-limiting, illustrated embodiment, the louver 12 includes a blade portion 18 that extends from a (e.g., round) pivot bar 20, there being a groove 22 between the blade portion 18 and the pivot bar 20. The blade portion 18 may be flat and taper in thickness in a direction away from the pivot bar 20. The blade portion 18 may have air flow structure (such as the tapered thickness or curvature or aerodynamic structure) for achieving different flow characteristics. The pivot bar 20 is received in a sealing channel 24 formed in sealing member 16. Sealing member 16 is received in a louver channel 26 formed in louver holder 14. The groove 22 allows the blade portion 18 to pivot in a wide angular range before abutting against edges of louver holder 14. Seal 16 prevents condensation from entering louver holder 14.

In FIG. 3, there are 5 rows of horizontally-oriented louvers 12, and in each row there are 4 louvers. Additionally or alternatively, the louvers may be vertical and arranged in columns. It is understood that the invention is not limited at all to this particular amount of rows, columns and louvers and may be carried out with other numbers of rows, columns and louvers. The louvers may be individually and independently adjusted (tilted to any desired angle), or each row or column may be arranged to be adjusted as one unit, or all of the louvers may be arranged to be adjusted as one unit.

The air conditioning diffuser assembly 10 includes a housing 28, which in the non-limiting, illustrated embodiment, is a flush-mount housing 28 that includes a room-facing border 30 from which extends a rear-facing frame 32, which may be rectangular, as shown, or oval, circular or any other shape. The frame 32 has a central opening 34 with a mounting border 36. The louvers 12 pass through opening 34.

The assembly of louvers 12, sealing members 16 and louver holders 14 may be mounted to mounting border 36 as follows. One or more mounting strips 38 are provided. Each mounting strip 38 includes a lug 40 (such as a cylindrical stub) which is received in sealing member 16, just as pivot bar 20 is received in sealing member 16. (Pivot bar 20 is pushed into sealing member 16 and can pivot with respect to sealing member 16; the lug 40 can be bigger so that it does not pivot, but it can also be exactly like pivot bar 20.) The mounting strips 38 are located in spaces or gaps between adjacent louvers 12. In the illustrated embodiment, the louvers are horizontal and the mounting strips 38 are vertical, but the invention is not limited to this arrangement.

The mounting strips 38 may be permanently affixed to frame 32, such as by means of screws, rivets, adhesive, welding and the like. However, in the illustrated embodiment, mounting strips 38 are removably (not permanently) affixed to frame 32 by means of magnetic fasteners 42 (e.g., made of neodymium iron boron alloy). For example, mounting strips 38 and mounting border 36 of frame 32 may be made of a ferromagnetic material (e.g., ferritic stainless steel and others), so that magnetic fasteners 42 are secured by magnetic force to mounting strips 38 and to mounting border 36, thereby affixing mounting strips 38 to frame 32. Alternatively, mounting strips 38 and mounting border 36 of frame 32 may be made of a non-ferromagnetic material (e.g., aluminum alloy, austenitic stainless steel and others). In such a case, ferromagnetic elements 44 may be fastened to mounting border 36 of frame 32 (e.g., by screws, adhesive, etc.) and magnetic fasteners 42 are secured by magnetic force to the ferromagnetic elements 44. The magnetic fasteners 42 may be secured to mounting strips 38 by fasteners, adhesive or any other suitable method.

Thus, the present invention provides an easily assembled, modular construction for an air conditioning diffuser assembly. The louvers 12 are pivotally mounted by pushing them into seals 16 affixed to louver holders 14 and released from the seals 16 and holders 14 by simply pulling them out from seals 16. In turn, the louver holders 14 are mounted to mounting strips 38 by pushing holders 14 together with portions (lugs 40) of mounting strips 38 and released by simply pulling out the lugs. The mounting strips 38 may be magnetically affixed to housing 28. The seals 16 prevent moisture from accumulating at the base of the louvers of the diffuser.

What is claimed is:

1. An air conditioning diffuser assembly comprising:

louvers mounted in a housing, each of louvers being pivotally mounted in a sealing channel formed in a sealing member received in a louver holder, said sealing channels and said sealing members extending over a majority of a length of each of said louvers, and each of said sealing members having sufficient sealing capability to prevent condensation from entering said louver holder.

2. The air conditioning diffuser assembly according to claim 1, wherein each of said sealing members is received in a louver channel formed in each of said louver holders.

3. The air conditioning diffuser assembly according to claim 1, wherein said sealing members are made of an elastomeric material.

4. The air conditioning diffuser assembly according to claim 1, wherein each of said louvers comprises a blade portion that extends from a pivot bar, there being a groove between said blade portion and said pivot bar, said pivot bar being received in said sealing channel.

5. The air conditioning diffuser assembly according to claim 4, wherein said blade portion tapers in thickness in a direction away from said pivot bar.

6. The air conditioning diffuser assembly according to claim 4, wherein said groove allows said blade portion to pivot in an angular range before abutting against edges of said louver holder.

7. The air conditioning diffuser assembly according to claim 1, wherein said housing comprises a frame and an assembly of said louvers, said sealing members and said louver holders are affixed to said frame by magnetic fasteners.

8. An air conditioning diffuser assembly comprising:

louvers mounted in a housing, each of louvers being pivotally mounted in a sealing channel formed in a sealing member received in a louver holder, said sealing member having sufficient sealing capability to prevent condensation from entering said louver holder, wherein said housing comprises a frame and an assembly of said louvers, said sealing members and said louver holders are affixed to said frame by magnetic fasteners, and wherein portions of mounting strips are received in said sealing members and said mounting strips are affixed to said frame by said magnetic fasteners.

9. The air conditioning diffuser assembly according to claim 8, wherein said mounting strips are located in spaces between louvers that are adjacent one another.

* * * * *